United States Patent [19]

Tamaru

[11] 4,198,808

[45] Apr. 22, 1980

[54] CALENDAR TIMEPIECE

[75] Inventor: Munetaka Tamaru, Tokyo, Japan

[73] Assignee: Citizen Watch Co., Ltd., Tokyo, Japan

[21] Appl. No.: 909,475

[22] Filed: May 25, 1978

[30] Foreign Application Priority Data

Jun. 3, 1977 [JP] Japan ..... 52/65411

[51] Int. Cl.[2] ..... G04B 19/24

[52] U.S. Cl. ..... 368/37; 368/35

[58] Field of Search ..... 58/4 R, 5, 23 R, 23 D, 58/58, 85.5, 125 R, 125 B, 126 R, 126 B

[56] References Cited

U.S. PATENT DOCUMENTS

| | | | |
|---|---|---|---|
| 2,595,467 | 5/1952 | Kellher | 58/4 A |
| 3,477,222 | 11/1969 | Leune et al. | 58/5 |
| 3,673,789 | 7/1972 | Tsuzuki et al. | 58/58 |
| 3,766,728 | 10/1973 | Nagy | 58/4 A |
| 3,827,234 | 8/1974 | Imanishi | 58/58 |
| 3,834,151 | 9/1974 | Bodet | 58/4 A |
| 3,992,868 | 11/1976 | Tamaru et al. | 58/5 |
| 4,026,100 | 5/1977 | Kume et al. | 58/4 R |

*Primary Examiner*—Vit W. Miska

*Attorney, Agent, or Firm*—Sherman & Shalloway

[57] ABSTRACT

A calendar timepiece which does not require any manual date correction at the end of even months is disclosed. The timepiece comprises an even months date correction claw mounted on a date rotational wheel and displaced into a correction position when a claw driving coil is energized by a signal delivered from means for discriminating odd months from even months.

13 Claims, 8 Drawing Figures

CALENDAR TIMEPIECE

BACKGROUND OF THE INVENTION

1. Field of the Invention

This invention relates to a calendar timepiece which does not require any manual date correction at the end of even months.

2. Description of the Prior Art

An ordinary calendar timepiece is provided with a display member for displaying dates for 31 days. The display member is transferred for one day by a driving force supplied from a timepiece. As a result, there is no problem occurrence at the month end of odd months. But, at the month end of even months, the 31st day is erroneously displayed instead of the 1st day as required, thereby requiring manual correction for one day.

Heretofore, it has been proposed to transfer a date plate for two days at night of the month end of the even months with a aid of a mechanical construction by controlling a discriminating cam for discriminating the odd months from the even months. But, such mechanical construction is composed of a combination of cams, levers, gears or the like and hence is complex in construction, large in number of parts and space and tends to induce failures.

SUMMARY OF THE INVENTION

An object of the invention, therefore, is to provide a calendar timepiece which can eliminate the above mentioned drawbacks which have been encountered with the prior art techniques, i.e., which is composed of a combination of an electrical system and a mechanical system and which is simple in construction and electrical in operation. In principle, use is made of a detection means in cooperation with a calendar. If the detection means detects the necessity of correcting the calendar, the member for correcting the even months date in cooperation with the date rotational wheel is controlled into a condition under which the date display member functions to correct, thereby correcting the date display error with the aid of a power for driving the timepiece.

A feature of the invention is the provision of a calendar timepiece comprising:

- a date display mechanism;
- a date rotational wheel;
- a first date correction mechanism consisting of a correction claw;
- a mechanism for discriminating odd months from even months; and
- a second date correction mechanism for correcting the date of month end in response to a signal delivered from said mechanism for discriminating odd months from even months.

BRIEF DESCRIPTION OF THE DRAWINGS

The invention will now be described in greater detail with reference to the accompanying drawing, wherein.

DESCRIPTION OF THE PREFERRED EMBODIMENTS

FIGS. 1 to 4 show one embodiment of a calendar timepiece according to the invention as applied to a crystal timepiece so as to display days, weeks and months.

Figure 1:
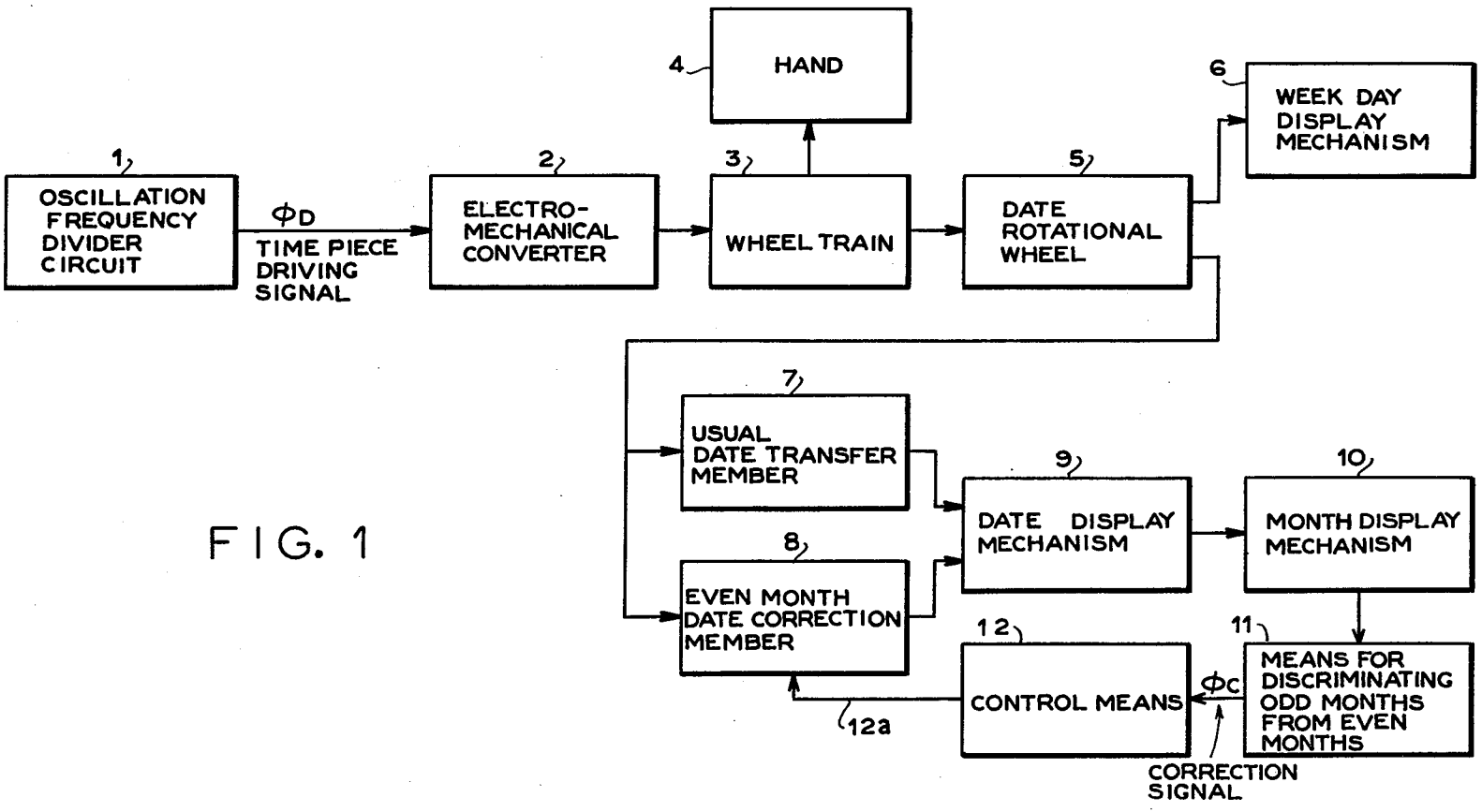
FIG. 1 is a block diagram of one embodiment of a calendar timepiece according to the invention.

FIG. 1 shows a block diagram of one embodiment of a calendar timepiece according to the invention. Reference numeral 1 designates an oscillation and frequency dividers circuit comprising an oscillation circuit including a crystal oscillator and producing a reference signal and a frequency divider circuit for dividing the frequency of the reference signal into a desired frequency so as to provide a timepiece driving signal $\phi_D$. The timepiece driving signal $\phi_D$ functions to drive an electro-mechanical converter 2. The electro-mechanical converter 2 functions to drive a wheel train 3 including a timepiece wheel train for rotating a hand 4 such as an hour hand, minute hand, second hand or the like and a calendar transfer wheel or the like. Rotation of the wheel train 3 is transmitted to a date rotational wheel 5 which constitutes an extension of the wheel train 3. The date rotational wheel 5 functions to drive a week day display mechanism 6 and also drive through a usual date transfer member 7 and even months correction member 8 a date display mechanism 9 and then drive a month display mechanism 10. The month display mechanism 10 is provided with a means 11 for discriminating odd months from even months. In the case of even months, the discrimination means 11 functions to deliver a correction signal $\phi_C$ to a control means 12. The control means 12 upon receipt of the correction signal $\phi_C$ from the means 11 for discriminating the odd months from the even months becomes operated in association with a frequency divider circuit to deliver a driving current 12*a* for a given time (for 2.5 hours in the present embodiment) to the even months correction member 8 so as to control it. After the even months correction member 8 has been controlled into a condition under which can correct dates, the control means 12 becomes inoperative.

Figure 2:
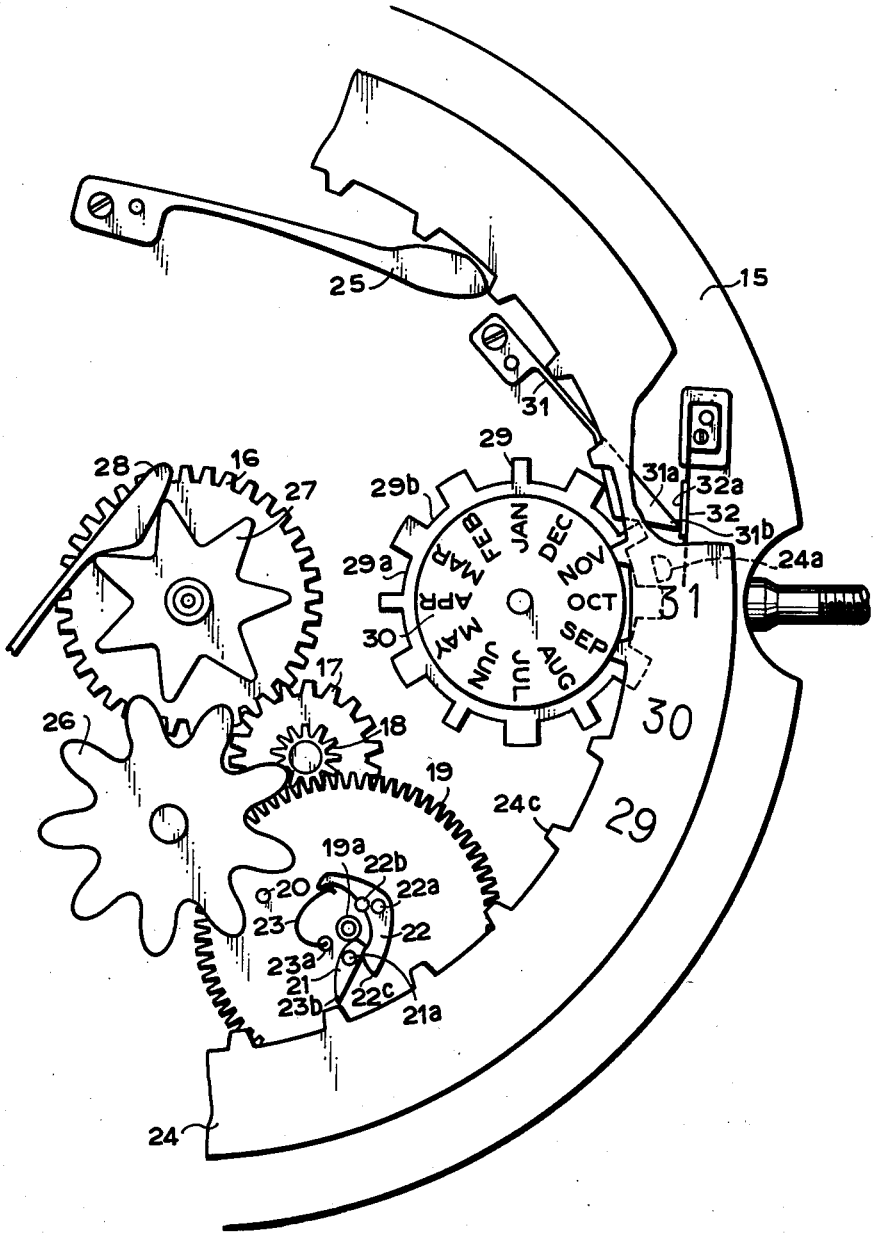
FIG. 2 is a plan view of a calendar mechanism according to the invention under a condition that the calendar mechanism has just changed into 31st day at 24th hour of 30th day of odd months.
Figure 3:
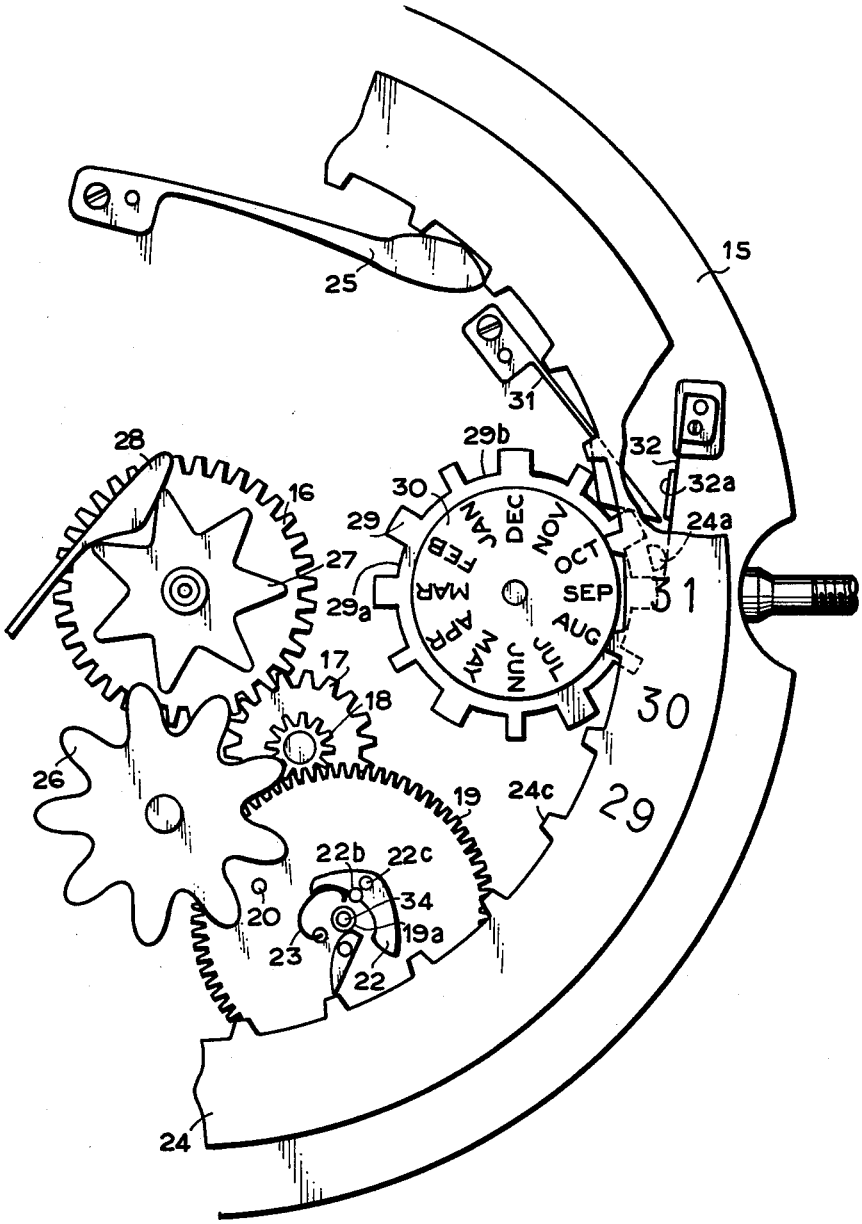
FIG. 3 is a plan view of the calendar mechanism shown in FIG. 2 under a condition that the calendar mechanism has just changed into 31st day at 24th hour of 30th day of even months.

FIGS. 2 and 3 are plan views of a calendar mechanism under different conditions. FIG. 2 shows a usual calendar mechanism under a condition immediately after it has been changed from 24 hour on the 30th day of the odd months (October in the present embodiment) to the 31st day. Referring to FIG. 2, reference numeral 15 designates a base plate; 16 a cannon wheel provided with an hour hand (not shown) driven by a conventional time counting mechanism; 17 a date rotation transfer wheel made integral with a date rotation transfer wheel pinion 18; 19 a date rotational wheel including a week day rotational transfer pin 20, a usual date transfer member, i.e., usual date transfer claw 21 and even months date correction member, i.e., even months date correction claw 22. The usual date transfer claw 21 is formed of a non-magnetic material such as plastics or the like and rotatably held by a first pin 21*a* secured to the date rotational wheel 19. The even months date correction claw 22 is formed of a non-magnetic material and provided at its one portion with a change-over iron piece 22*b* formed of a magnetic material. The even months date correction claw 22 is rotatably held by a second pin 22*a* secured to the date rotational wheel 19. Provision is made of a very weak claw spring 23 having one end fixed to a shaft 23*a* secured to the date rotational wheel 19 and the other end causing the even months date correction claw 22 to rotate about the second pin 22*a* in a clockwise direction. As a result, under ordinary circumstances, the usual date transfer claw 21 is subjected to the torque of the even months date correction claw 22 so as to rotate about the first pin 23*a* in a counter clockwise direction and make contact with the date rotational wheel shaft 19*a*. As a result, the usual date transfer claw 21 functions to drive a tooth 24*c* of a date plate 24 only when the date rotational wheel 19 is rotated in clockwise direction. If the date rotational wheel 19 is rotated in counter clockwise direction, the claw spring 23 becomes bent to cause the front end 23*b* of the usual date transfer claw 21 to retreat toward the center of the date rotational wheel 18. Under such condition, the front end 22*c* of the even months date correction claw 22 is located at that radius which is not engaged with the tooth 24*c* of the date plate 24. The date plate 24 is provided with a month plate transfer pin 24*a* and located by a date stir control level 25. A week rotational transfer wheel 26 is driven by a week rotational transfer pin 20 and functions to rotate a week star wheel 27 provided with a week plate (not shown). Reference numeral 28 designates a week stirring control level; 29 a cam for discriminating the odd months from the even months and provided with a month display plate 30 made integral therewith; and 31 a month stirring control level having one end secured to the base plate 15 and the other end engaged with the cam 29 for discriminating the odd months from the even months and having a front end portion 31*a* which is depressed to permit a month plate transfer pin 24*a* to pass through the depressed part end portion 31*a*. The contact portion between the discrimination cam 29 and the month stirring control lever 31 is so shaped that, in the case of displaying the even months, the contact portion arrives at a wide depression 29*a* while in the case of displaying the odd months, the contact portion arrives at a narrow depression 29*b*. As a result, in the case of displaying the odd months, the month stirring control lever 31 is kept away from the center of the discrimination cam 29. Reference numeral 32 designates a switch spring having one end secured to the base plate 15 and insulated therefrom and a center portion 32*a* covered with an insulating material. The front end 31*b* of the month stirring control lever 31 is urged against the insulated portion 32*a* of the switch spring 32 so as to separate the switch spring 32 from the month plate transfer pin 24*a*. This condition corresponds to the month end of the odd months. As a result, the usual date transfer claw 21 only operates in just the same manner as a timepiece which is not provided with a month end date non-correction mechanism. The even months date correction claw 22 does not operate in the same manner as the timepiece which is not provided with the month end date non-correction mechanism even at times other than the month end.

FIG. 3 shows a condition under which immediately after 24 hour of 30 day of the even months (September in the present embodiment) the date is changed into 31st day. In the present condition, the month stirring control lever 31 becomes engaged with the wide depression 29*a* of the discrimination cam 29 and approaches to the center of the cam 29, thereby releasing the switch spring 32. As a result, the switch spring 32 enters into the locus of the date plate transfer pin 24*a* and makes contact therewith. The correction signal $\phi_C$ is transferred from the date plate transfer pin 24*a* to the switch spring 32 and then supplied to a circuit for constituting the control means 12. As a result, a driving coil 33 (FIG. 4) of the even months date correction claw 22 is energized to magnetize a driving core 34 made integral with the shaft 19*a* of the date rotational wheel 19. The driving core 34 causes a change-over iron piece 22*b* to be attracted toward the date rotational wheel shaft 19*a* against the spring force of the claw spring 23. As a result, the even months date correction claw 22 is moved to a position where the claw 22 can drive the tooth 24*c* of the date plate 24. This condition is held for 2.5 hours during which the driving coil 33 is energized. The date rotational wheel 19 is rotated by the usual driving force of the timepiece. Within a time of the order of 2 hours, the date plate 24 is further transferred by one day, thereby changing its display from the 31st day to the 1st day. After 2.5 hours, the claw driving coil 33 is deenergized and the even months date correction claw 22 is returned to its ordinary condition shown in FIG. 2 by the spring force of the claw spring 23.

Figure 4:
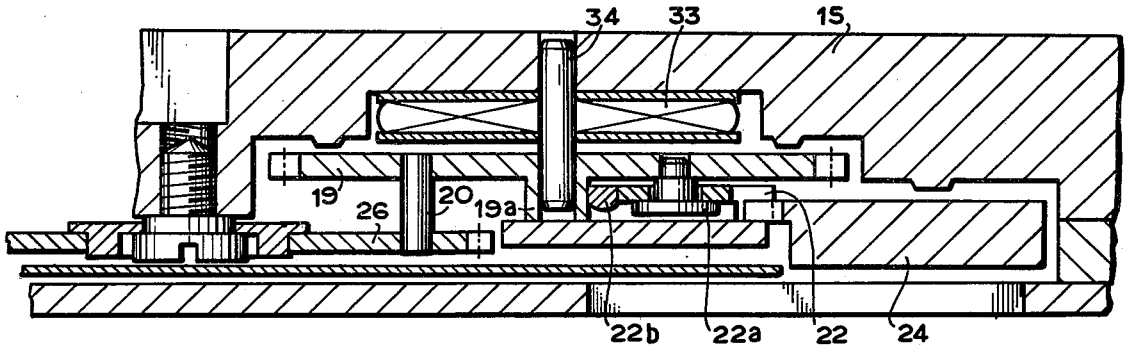
FIG. 4 is an enlarged cross-sectional view of one embodiment of an even months date correction claw mounted on a date rotational wheel.

FIG. 4 shows the date rotational wheel 19 in an enlarged cross-section under such condition that the even months date correction claw 22 is correctly driving the date plate 24. One end of the driving core 34 formed of a magnetic material such as permalloy or the like and provided with the claw driving coil 33 wound thereabout is secured to the base plate 15, while the other end is made integral with the rotational shaft 19*a* of the date rotational wheel 19. The even months date correction claw 22 for holding the change-over iron piece 22*b* engaged with the date rotational wheel shaft portion 19*a* is rotatably held by a second pin 22*a* secured to the date rotational wheel 19.

Figure 5:
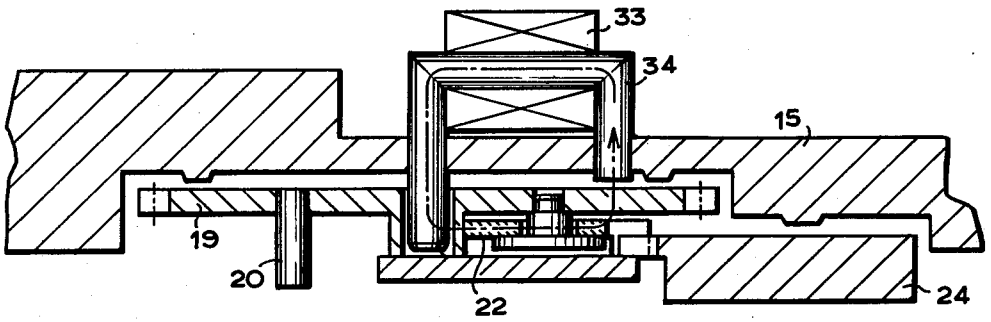
FIG. 5 is an enlarged cross-sectional view of another embodiment of the even months date correction claw shown in FIG. 4.

FIG. 5 shows a second embodiment of the present invention. In the present embodiment, a driving core 34 formed of a magnetic material is bent into a U-shaped one having a common yoke. Around the common yoke is wound the claw driving coil 33. A part or all of the even months date correction claw 22 is formed of a magnetic material so as to provide a magnetic circuit having an improved efficiency.

Figure 6:
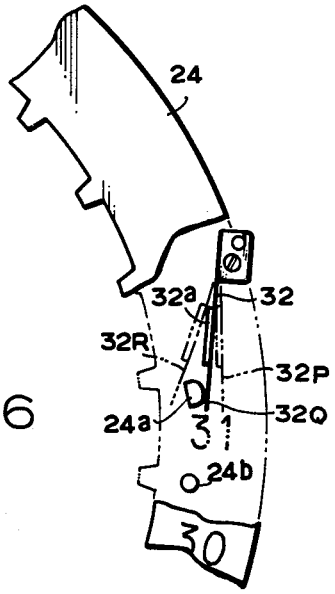
FIG. 6 is a plan view of means for discriminating odd months from even months.
Figure 7:
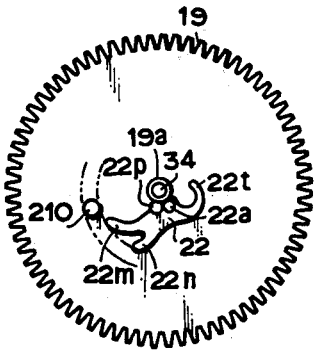
FIG. 7 is a plan view of a further embodiment of the even months date correction claw shown in FIG. 4 under a usual date deliver condition.
Figure 8:
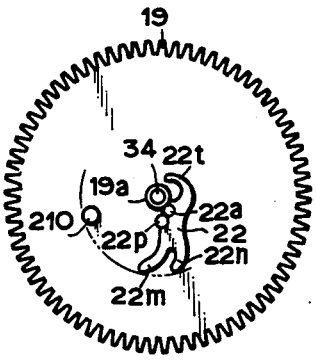
FIG. 8 is a plan view of the even months date correction claw shown in FIG. 7 under a condition that the even months date correction claw is held at its correction position.

FIGS. 6 to 8 show a third embodiment of the present invention. In the previous embodiment, February end is not automatically corrected. In the present embodiment, both the discrimination means 11 and the even months date correction member 8 are increased in capacity so as to permit various kinds of calendar correction. For example, February 29 is automatically corrected as follows. If the 30th day is displayed on March 1, it is required to effect an automatic correction for two days. For this purpose, the discrimination means 11 will now be described with reference to FIG. 6. A second month plate transfer pin 24b is located at a position which is shorter in radius than the first month plate transfer pin 24a corresponding to the 30th day display. The switch spring 32 is controlled by the discrimination cam 29 such that the switch spring 32 takes three positions of 32P, 32Q and 32R corresponding to odd months, even months and February (the 29th day in the present embodiment), respectively. The control means 12 functions as a counter for correcting two days.

In the case of the odd months, the switch spring 32 is located at the 32P and hence does not make contact with the month plate transfer pins 24a, 24b. In the case of the even months, the switch spring 32 is located at the 32Q and hence makes contact with the first month plate transfer pin 24a arranged at a position which is larger in radius than the second month plate transfer pin 24b when the 31st day is displayed, thereby delivering a correction signal $\phi_C$ for one day.

In the case of February, the switch spring 32 is located at the 32R and hence makes contact with the second month plate transfer pin 24b when the 30th day 24 hours are displayed, thereby delivering a correction signal $\phi_C$ for one day. If the date is changed into the 31st day, the switch spring 32 makes contact with the first month transfer pin 24a to deliver a correction signal $\phi_C$ for one day, thereby changing the date to the 1st day. If the correction signal $\phi_C$ is supplied to the control means 12, the control means 12 functions to supply the driving current for 2–5 hours which is longer than the practical current supply time, and as a result, the driving current supplied reaches to a value which is supplied for two days in total.

FIGS. 7 and 8 show another embodiment of the even months date correction claw 22 and usual date delivery claw 21. In the present embodiment, provision is made of a simple date delivery pin 210 corresponding to the usual date delivery claw 21. An even months date correction claw 22 is provided at its one end with a long arm 22m and a short arm 22n and at substantially center thereof with a magnet 22p and rotatably held by a second pin 22a secured to the date rotational wheel 19. Under the usual date transfer condition shown in FIG. 7, the magnet 22p is attracted toward the driving core 34 formed of the magnetic material and cause the even months date correction claw 22 to rotate about the second pin 22a in counter-clockwise direction and make contact with the date rotational wheel shaft portion 19a, and as a result, the two arms 22m, 22n of the even months date correction claw 22 are located at a position where these arms do not make contact with the tooth 24c of the date plate 24.

In the case of the 31st day of the even months and 30th and 31st days of February, the even months date correction claw 22 becomes located at a position shown in FIG. 8. That is, if the switch spring 32 functions to deliver the correction signal $\phi_C$, the control means 12 functions to deliver the driving current 12a operative to repulse the magnet 22p from the driving core 34. As a result, the even months date correction claw 22 is rotated about the second pin 22a in counter clockwise direction until the stopper arm 22t engages with the rotational wheel shaft portion 19a. As a result, the arms 22m, 22n of the even months date correction claw 22 arrive at a position where they engage with the tooth 24c of the date plate 24. In the usual even months, the first longer arm 22m functions to cut off the driving current 12a when the 31st day has been corrected and the magnet 22p functions to attract the even months date correction claw 22 to the condition shown in FIG. 7.

In the case of February, even after the correction of the 30th day has been completed, the control means 12 upon receipt of the correction signal $\phi_C$ for the 31st date functions to deliver again the driving current 12a to the even months date correction member 8, thereby holding the even months date correction claw 22 at a position where it can correct even months date. The first arm 22m functions to correct the 30th date, while the second arm 22n functions to correct the 31st date.

In the third embodiment, February 28th day is corrected. On the contrary, February 29th day only can simply be corrected.

The discrimination means 12 for discriminating the odd months from the even months will now be described with reference to FIG. 6. The second months plate transfer pin 24b is displaced to the position of the 29th day and the correction signal $\phi_C$ is delivered from the discrimination means 11 to the control means 12 at the instant of displaying February 29th day when March 1st should be displayed. The even months date correction member 8 will now be described. with reference to FIG. 7. In this case, the even months date correction claw 22 provided on the date rotational wheel 19 is provided at its one end with three arms for transferring the 29th, 30th and 31st dates, respectively.

In the case of correcting the date, the driving current 12a is supplied from the control means 12 to the even months date correction member 8 for 2.5 hours. In practice, however, if the even months date correction claw 22 engages with the tooth 24c of the date plate 24, the correction claw 22 could not be returned to its original position. As a result, clearance between parts can considerably be reduced by taking the working error into consideration.

As stated hereinbefore, the invention is capable of detecting the necessity of correcting the date with the aid of means for discriminating the odd months from the even months and of electrically changing over the date correction member cooperating with the date rotational wheel. As a result, the invention renders it possible to considerably omit such mechanical construction which is not reliable in operation, thereby improving freedom in construction. In addition, energy required for correcting the date is not directly used for correcting the date, but is used for changing over the date correction claw which is small in size, so that the calendar timepiece according to the invention is remarkably effective in operation and is high in efficiency.

What is claimed is:

1. A calendar timepiece comprising:

(a) a date display mechanism;

(b) first means for driving said date display mechanism;

(c) means for actuating said first means;

(d) means for discriminating odd months from even months, (e) an electromagnetic driving means including a driving coil and a core, said electromagnetic driving means driven by an output signal from said discriminating means; and (f) second means for driving said date display mechanism and actuated by said electromagnetic means for correcting the last day of each month with 30 days or less.

2. The calendar timepiece as claimed in claim 1 further comprising a second date transfer claw driven by said first date rotational wheel for correcting the end of each month with 30 day or less.

3. The calendar timepiece as claimed in claim 1 wherein:

said date display mechanism includes a date plate and a date stir control lever;

said first means is comprised of a single date rotational wheel driving said date plate;

said means for actuating is comprised of a first date transfer claw provided on said date rotational wheel said means for discriminating is comprised of a discriminating cam and a positioning lever; and said second means is comprised of a second date transfer claw provided on said date rotational wheel and controlled by said electromagnetic driving means.

4. The calendar timepiece as claimed in claim 3 wherein a month display plate is integral with said discriminating cam.

5. The calendar timepiece as claimed in claim 3 wherein said positioning lever operates as a trigger switch of said electromagnetic driving means.

6. The calendar timepiece as claimed in claim 3 wherein said core of said electromagnetic driving device also operates as the center axis of said single date rotational wheel.

7. The calendar timepiece as claimed in claim 4 wherein said discrimination cam is provided around the periphery of said month display plate with long and short recesses corresponding to the odd months and even months, respectively; and a month stirring control lever and switch spring make contact with a first date plate transfer pin when said month stirring control lever engages said long recess corresponding to the even months.

8. The calendar timepiece as claimed in claim 7 further comprising a second month plate transfer pin located at a position shorter in radius than said first month plate transfer pin corresponding to the 30th day; and said switch spring controlled by said discrimination cam so as to take three positions corresponding the 31st day, 30th day and 29th day whereby the 29th day of month end is also corrected automatically.

9. The calendar timepiece as claim 8 wherein said switch spring takes four positions corresponding to the 31st day, 30th day, 29th day and 28th day whereby the 28th of the month end is also corrected automatically.

10. The calendar timepiece as claimed as claim 8 wherein said first date transfer claw is provided with three arms consisting of a first long arm, a second short arm and a third stopper arm, and a magnet secured to the first claw, said magnet being actuated by said core of said electromagnetic device to rotate said first date transfer claw.

11. The calendar timepiece according to claim 6 wherein said driving coil is interposed between a base plate and said date rotational wheel.

12. The calendar timepiece according to claim 3 wherein said date correction claw is made of a magnetic material and is magnetically conductive together with said core.

13. A calendar timepiece comprising:

(a) an oscillation and frequency divider circuit for preparing a timepiece driving signal;

(b) an electro-mechanical converter for converting said timepiece driving signal delivered from said circuit into a mechanical energy;

(c) a wheel train driven by an output delivered from said electro-mechanical converter;

(d) hand means connected to said wheel train;

(e) a date rotational wheel driven by said wheel train;

(f) a week day display mechanism driven by said date rotational wheel and displaying week days;

(g) an even months date correction member operative in cooperation with said date rotational wheel;

(h) a date display mechanism including a date display member driven by an output delivered from said even months date correction member and displaying 31 days;

(i) means for discriminating odd months from even months driven by an output delivered from said date display mechanism and discriminating odd months from even months; and (j) electromagnetic control means inserted between said means for discriminating odd months from even months and said even months date correction member and controlling said even months date correction member in response to a signal delivered from said means for discriminating odd months from even months.

* * * * *